US005382061A

United States Patent [19]

Swift et al.

[11] Patent Number: 5,382,061

[45] Date of Patent: Jan. 17, 1995

[54] BAG SEAL

[75] Inventors: Allan W. Swift, Denville; Donald A. Ruth, Newton, both of N.J.

[73] Assignee: E.J. Brooks Company, Newark, N.J.

[21] Appl. No.: 19,792

[22] Filed: Feb. 19, 1993

[51] Int. Cl.[6] ..... B65D 27/30

[52] U.S. Cl. ..... 292/311; 292/325

[58] Field of Search ..... 292/307 R, 311, 312, 292/313, 325, 308, 318–322; 70/439, 440

[56] References Cited

U.S. PATENT DOCUMENTS

| | | | |
|---|---|---|---|
| 349,873 | 9/1886 | Brooks . | |
| 1,577,372 | 3/1926 | Seline et al. | 292/307 R |
| 1,822,390 | 9/1931 | Brooks | 292/315 |
| 2,639,181 | 5/1953 | Moberg | 292/315 |
| 2,669,476 | 2/1954 | Brooks | 292/308 |
| 3,117,812 | 1/1964 | Brooks et al. | 292/311 |
| 3,167,340 | 1/1965 | Brook et al. | 292/311 |
| 3,172,692 | 3/1965 | Brooks | 292/311 |
| 3,292,961 | 12/1966 | Morberg | 292/311 |
| 3,737,185 | 6/1973 | Reed | 292/308 |
| 5,257,520 | 11/1993 | Miller | 70/333 A |

FOREIGN PATENT DOCUMENTS

| | | | |
|---|---|---|---|
| 14235 | of 1909 | United Kingdom | 70/440 |

*Primary Examiner*—Peter M. Cuomo
*Assistant Examiner*—Darnell M. Boucher
*Attorney, Agent, or Firm*—William Squire

[57] ABSTRACT

An improved bag seal of the type typically used to close and seal the necks of cloth or other similar bags with a flexible strap. One end of the strap is attached to a non-resilient ferrule having an elongated housing with a passage therethrough for receiving the second end of the strap. The housing is received within a bore of a sealing block and thereafter is crimped to lock the housing to and within the sealing block and the strap to and within the housing. One or more cutting edges formed on the exterior of the housing permit insertion of the housing within the bore without cutting the sealing block, but upon attempted removal of the housing, the cutting edge cuts into the sealing block to provide a visual indication of tampering. Moreover, before passing the second end of the strap through the passage in the housing, the strap is passed through a slot in a flap rotatably mounted to the sealing block near an end of the bore. With the strap through the slot, the flap is held in a rotated position along the path of movement of the housing and the bore. Upon attempted separation of the housing from the bore, the flap becomes partially or completely detached from the sealing block, thereby providing another visual indication of tampering with the seal. Identifying indicia are affixed to the seal to prevent the disassembly and subsequent reassembly of the seal with counterfeit components.

16 Claims, 7 Drawing Sheets

FIG. 8a
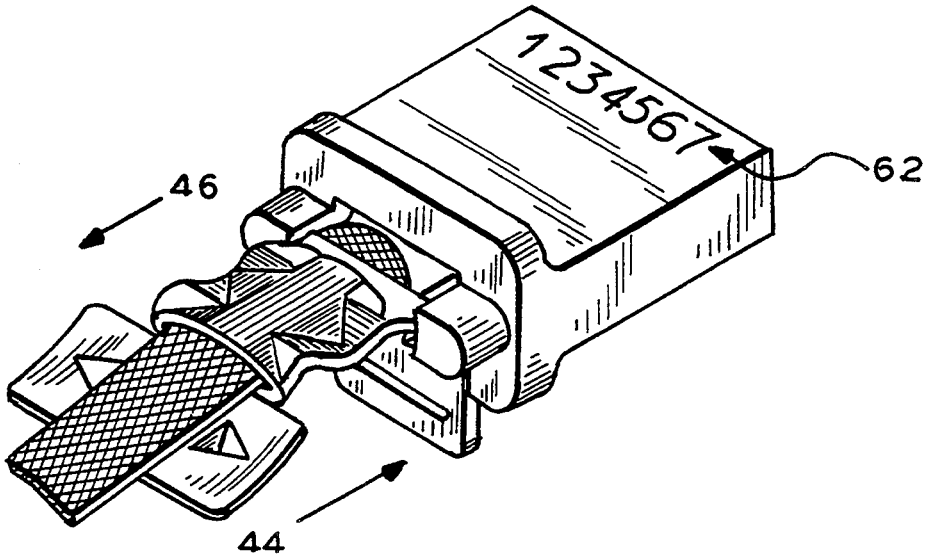
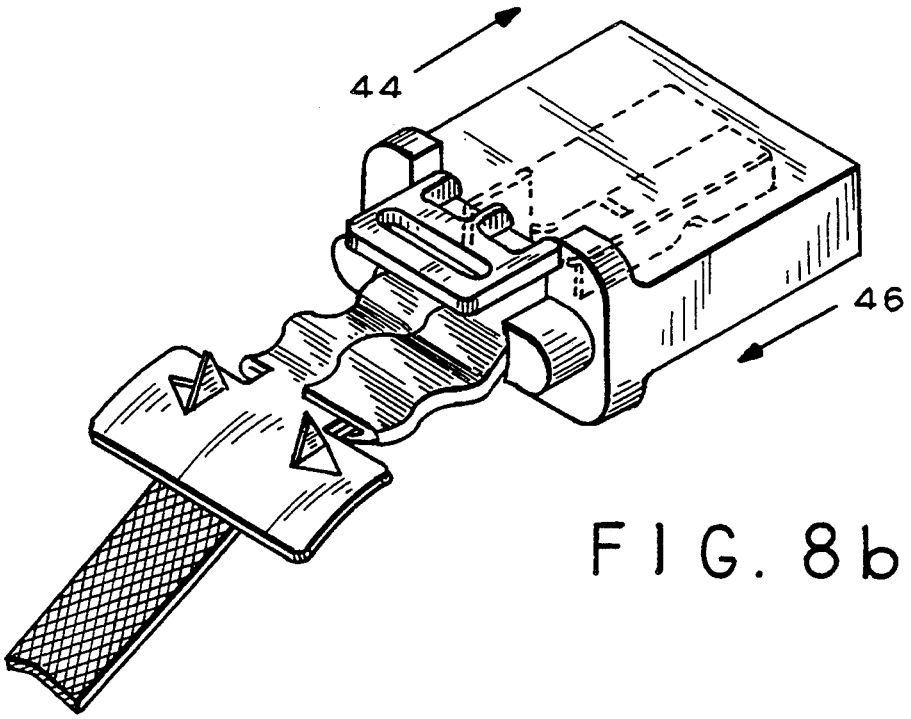
FIG. 8b

BAG SEAL

BACKGROUND OF THE INVENTION

The present invention relates to an improved bag seal, and more particularly relates to the type of seal typically used to close and seal the necks of cloth or other similar flexible bags which contain money, merchandise or the like.

U.S. Pat. Nos. 3,117,812 and 3,167,340 assigned to the assignee of the present invention disclose a type of prior art bag seal in common use. The bag seal includes a flexible strap or tape, made of polyethylene or other plastic, and a non-resilient ferrule or clinching element. The ferrule is formed or folded from a non-resilient material, such as bendable sheet steel or plastic, to assume the configuration of an elongated member having at one end a housing or sealing clinching portion and at the other end, an integral planar member or flag which may include integral prongs. Between the planar member and the housing is an integral tubular portion. Both the housing and the tubular portion may result from appropriately folding wing elements of a stamped non-resilient blank. A first end of the strap is inserted into the tubular portion of the ferrule. The tubular portion is then clinched, crimped or otherwise deformed about the first strap end to firmly attach and mount the strap to the ferrule. The housing defines a passage which is capable of receiving the second end of the strap and permits the strap to be slid or pulled there through.

The prior art seal also includes a plastic body or sealing block with a bore therethrough. The body or sealing block is preferably molded polyethylene or other material which is capable of being deformed and of retaining its deformed shape. The bore is capable of receiving therein the housing of the ferrule, with the strap-ferrule crimp connection and the planar member or flag being exterior to the body or sealing block.

The housing portion of the ferrule is inserted into the bore of the plastic body by the seal manufacturer. Subsequently, the free second end of the strap is wrapped around the neck of the bag by the end user and the second strap end is then passed through and then out of the passage of the housing. Since the housing and its passage are within the bore of the plastic body, the foregoing movement of the second strap end also moves it into and through the bore. The strap is then pulled tight to securely close the neck of the bag. Following this, clinching or crimping force is applied to the exterior of the plastic body to simultaneously deform the body and the inserted housing. The tightening of the strap and the clinching/crimping of the sealing block and the housing may be performed by the tool disclosed in commonly assigned U.S. Pat. No. 3,911,970.

Theoretically, the deformation of the housing locks it to the strap and the conjoint deformation of the housing and the sealing block prevents removal of the housing from the sealing block. The prongs on the planar member, which are sandwiched between the strap and the neck of the bag, are positioned so as to dig into the neck of the bag to prevent the now-closed seal from being slid from such neck.

One of the wings which is folded to produce the tubular portion of the ferrule overlies the other wing. When the bag seal closes the neck of the bag, the overlapping wings face and lie next to the bag. Accordingly, access to the wings is quite restricted. Furthermore, the deformed sealing block surrounds the housing and thus the folded wings which form the housing, thereby restricting access thereto. An attempt to gain access to the housing, for purposes of unfolding its wings, requires cutting, deforming or penetrating the sealing block. Such cutting deformation or penetration provides a visual indication of the attempt.

In practice, interlopers typically do not attempt to uncrimp the connection between the first end of the strap and the tubular portion of the ferrule, because of the restricted access to the wings which make up the tubular portion. If, however, the tubular portion is attacked, since the crimp connection between the strap and the ferrule cannot be accurately reassembled, a visual indication is therefore provided that there has been an unauthorized removal or attempted removal of the seal from the bag. Instead, interlopers will usually attempt to separate the housing from the surrounding sealing block to thereby expose the housing.

A primary object of the present invention is to improve prior art bag seals to provide a visual indication that unauthorized removal or attempted removal of the seal from the bag by removal of the housing from the sealing block has occurred.

SUMMARY OF THE INVENTION

With the above and other objects in view, the present invention relates to an improved bag seal of the type which has a flexible strap for encircling and holding closed the neck of a bag. The seal includes a plastic body or sealing block with a bore therethrough. A metal ferrule is attached to a first end of a strap. The ferrule includes an elongated housing or sealing clinching portion having a passage therethrough. The passage is capable of conformally receiving the strap after its second end passes therethrough.

The housing itself is receivable in the bore of the plastic body and is inserted into the bore. In use, after the strap has been passed around the neck of a bag, its second end is passed through the passage and pulled tight. This causes the strap to encircle and close the neck of the bag. Following this, the sealing block is crimped, clinched or otherwise deformed so that it and the housing within the bore are crimped and deformed, thereby locking the housing to and within the sealing block and the second end of the strap to and within the housing.

The present invention relates to facilities for providing visual indications of removal or attempted removal of the housing from the bore of the sealing block.

In a first aspect, the present invention contemplates the formation of one or more cutting edges formed on the exterior of the housing. These cutting edges are formed and located so as to permit reception of the housing in the bore of the sealing block without adversely affecting the housing. However, in response to relative movement between the housing and the sealing block incident to separation or attempted separation of the housing from the bore, the cutting edges cut into the sealing block. The cut in the sealing block provides a visual indication of separation or attempted separation of the housing from the bore. Thus, even if an attempt has been made to reassemble the seal after its separation or disassembly, a visual indication of tampering remains.

In a second aspect, the invention contemplates a flap which is rotatably and integrally attached to the sealing block near an end of the bore. The flap has a slot through which the strap and its second end may pass before passing through the passage in the housing. With the strap through the slot and the passage, the flap is held in a rotated position which lies along or on the path of movement of the housing and/or the bore when separation thereof is affected. Separation or attempted separation of the housing and the bore results in the partial or complete detachment of the flap from the sealing block. This detachment provides a visual indication of the separation or attempted separation of the housing from the bore.

In the third aspect, the invention contemplates the use of identifying indicia stamped onto the flexible strap and the sealing block. The identifying indicia permit the end user of the bag seal to know exactly which strap and which sealing block are being utilized to seal a specific bag. Should an interloper attempt to tamper with the seal, the present invention will provide evidence of the attempted tampering. The interloper may attempt to reassemble the seal using a new strap and/or a new sealing block. It is not likely that an interloper can adequately mark a new strap or sealing block in the field. Because each marking will be unique, it will be substantially impossible for an interloper to construct a believable counterfeit in the field. As a result, the end user will be more likely to identify attempts at tampering.

In preferred embodiments, the cutting edges on the ferrule are formed by making appropriate cuts, grooves, or points in the ferrule of the prior art. In other preferred embodiments, the flap is attached to the sealing block by a living hinge or other weakened juncture which ensures the detachment or tearing of the flap from the sealing block in the event that relative housing-sealing block movement is attempted.

BRIEF DESCRIPTION OF THE DRAWINGS

FIGS. 8*a*–8*b* are perspective views showing the ferrule connected to the sealing block according to the present invention;

DETAILED DESCRIPTION

Figure 1:
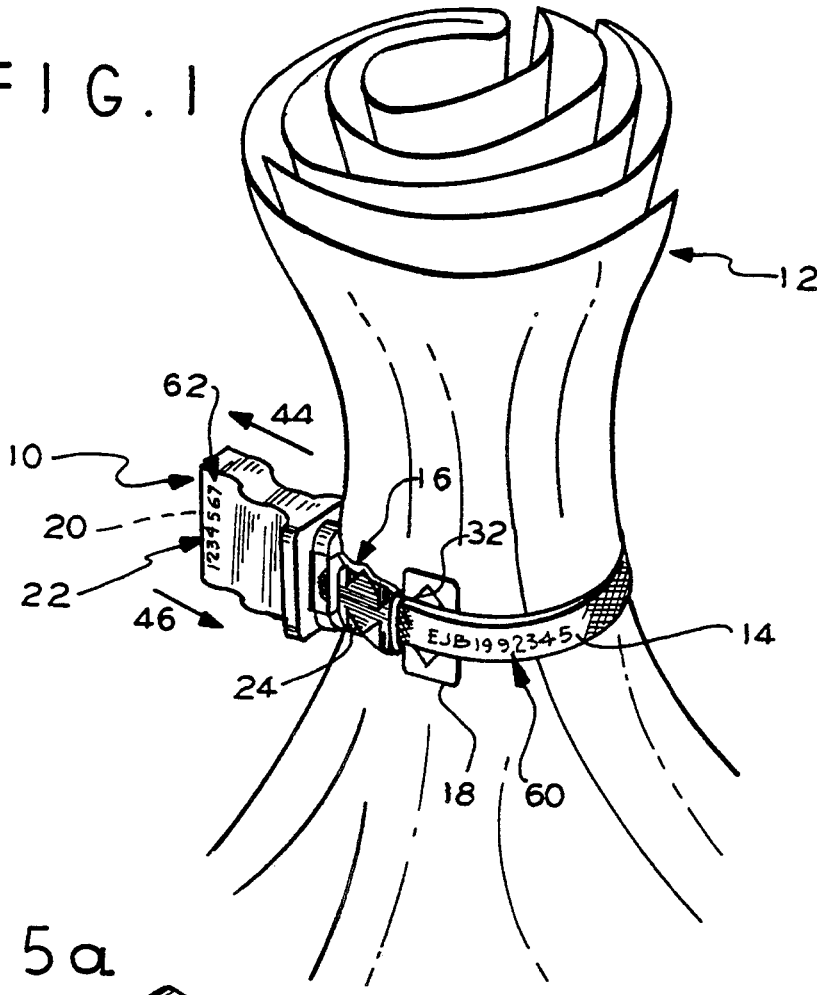
FIG. 1 is a perspective view of a bag seal according to the present invention, the seal closing the neck of a bag.
Figure 9A:
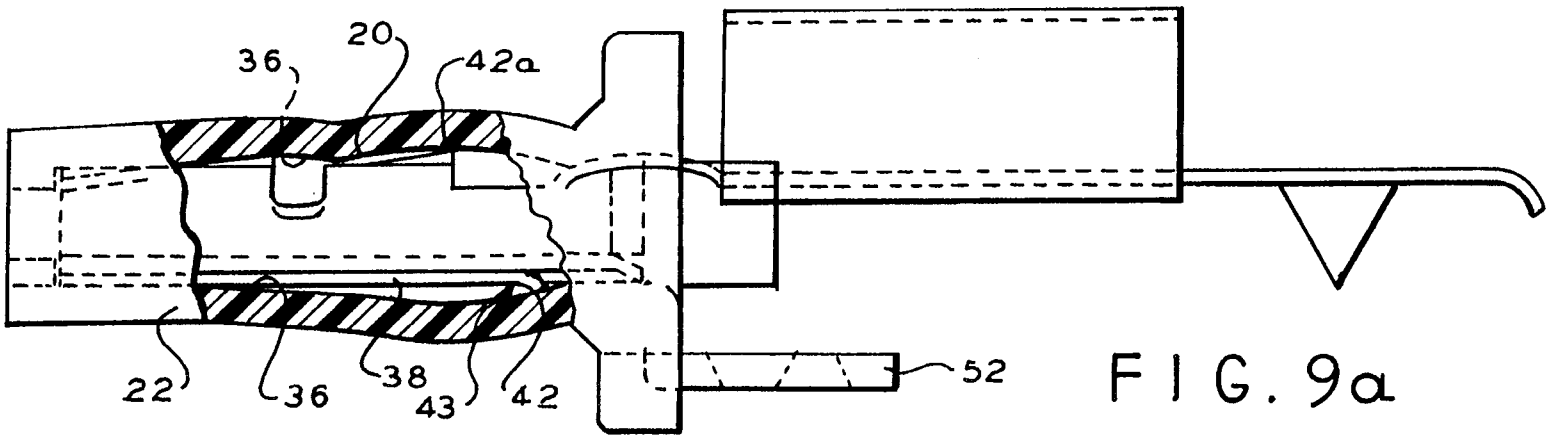
FIGS. 9*a*–9*d* show the sequence of operation of the present invention.
Figure 9B:
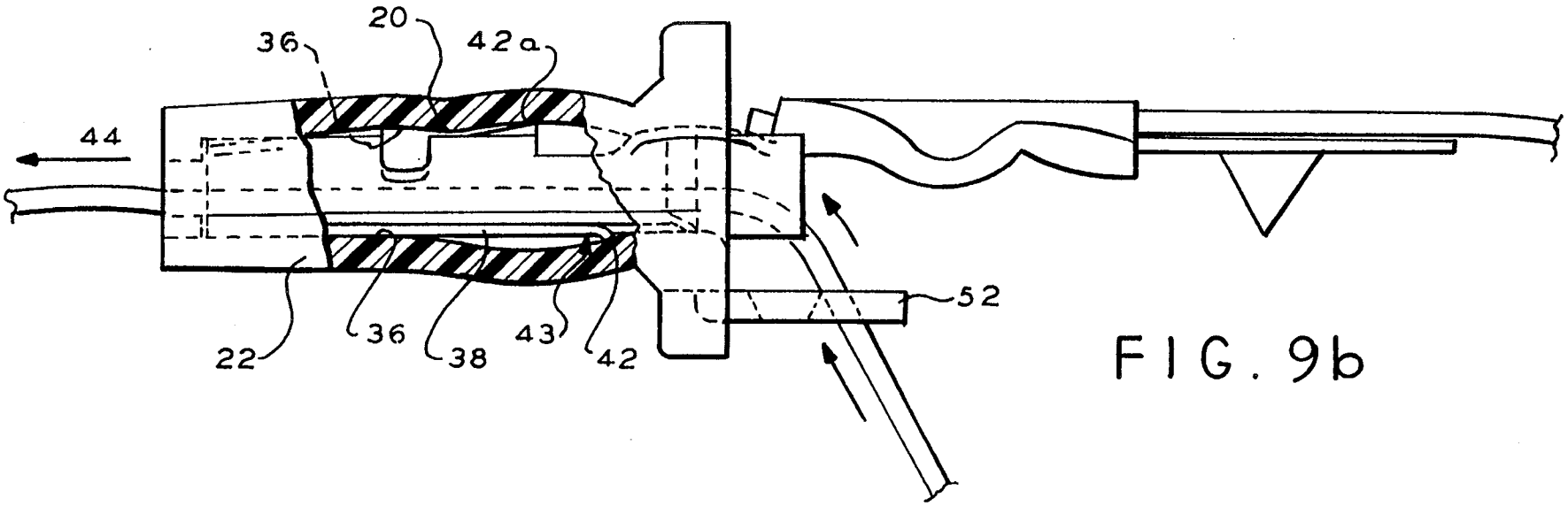
Figure 9C:
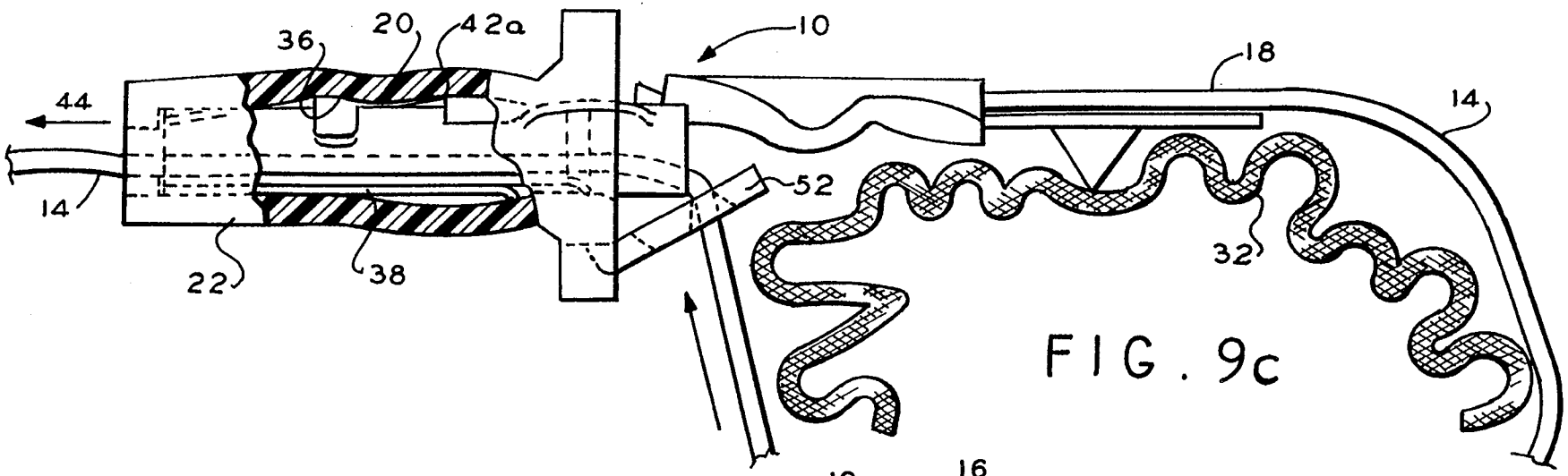
Figure 9D:
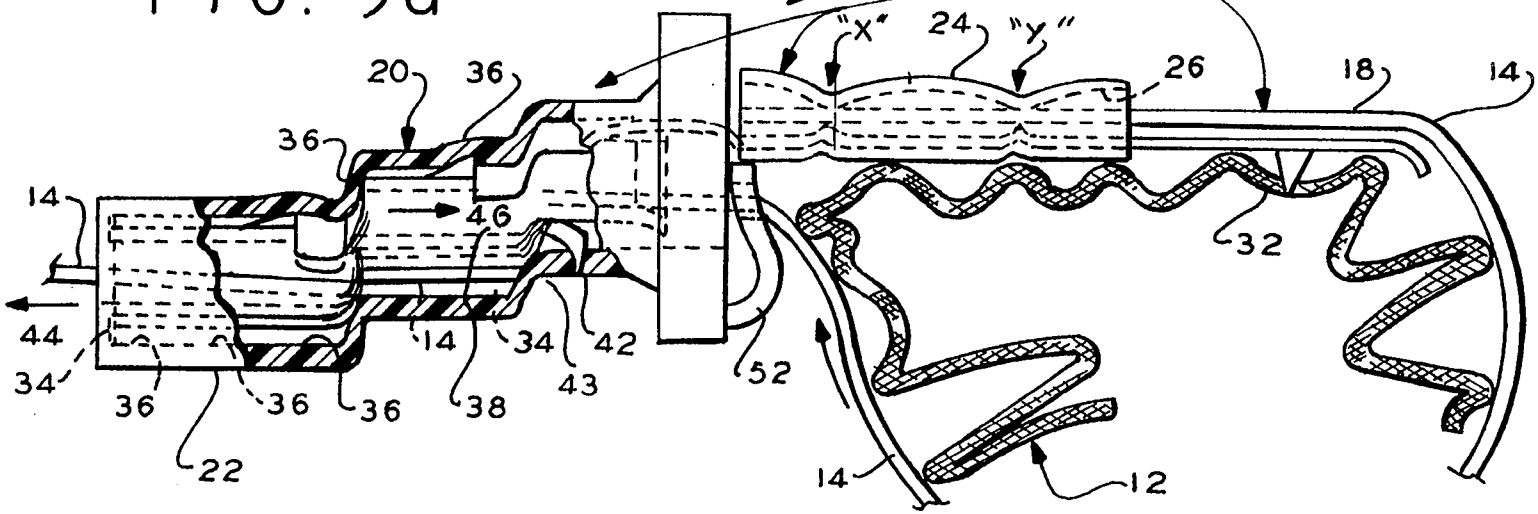

FIGS. 1 and 9*d* depict a bag seal 10 according to the present invention in use to seal the neck of a bag 12 containing money or other items. The function of the seal 10 is to close the bag 12 and restrict access to its contents, while giving a visual indication of an attempt, successful or not, to defeat or remove the seal 10.

The seal 10 includes an elongated, flexible strap or tape 14, preferably made of polyethylene. Attached to a first end of the strap 14 is a ferrule or clinching element 16. The ferrule 16 is made of a non-resilient material, such as bendable sheet steel or another relatively non-resilient metal or plastic, which retains any shape into which it is formed. The ferrule 16, which is preferably developed by folding an appropriately formed planar blank, includes a planar member or flag 18 at one end of the ferrule 16 and a housing or sealing clinching portion 20 at the other end. The housing 20 is not visible in FIG. 1, being hidden by a plastic body or sealing block 22, but is shown in FIGS. 2, 3, 4, and 9. Between the flag 18 and the housing 20 is a tubular portion 24.

Figure 3:
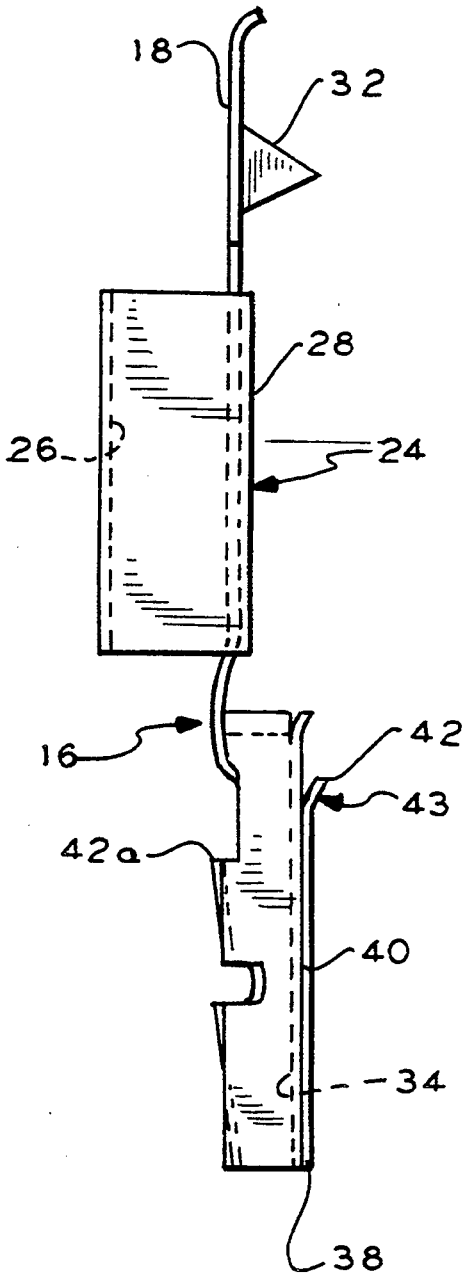
FIG. 3 is a side elevation of the ferrule shown in FIG. 2.
Figure 2:
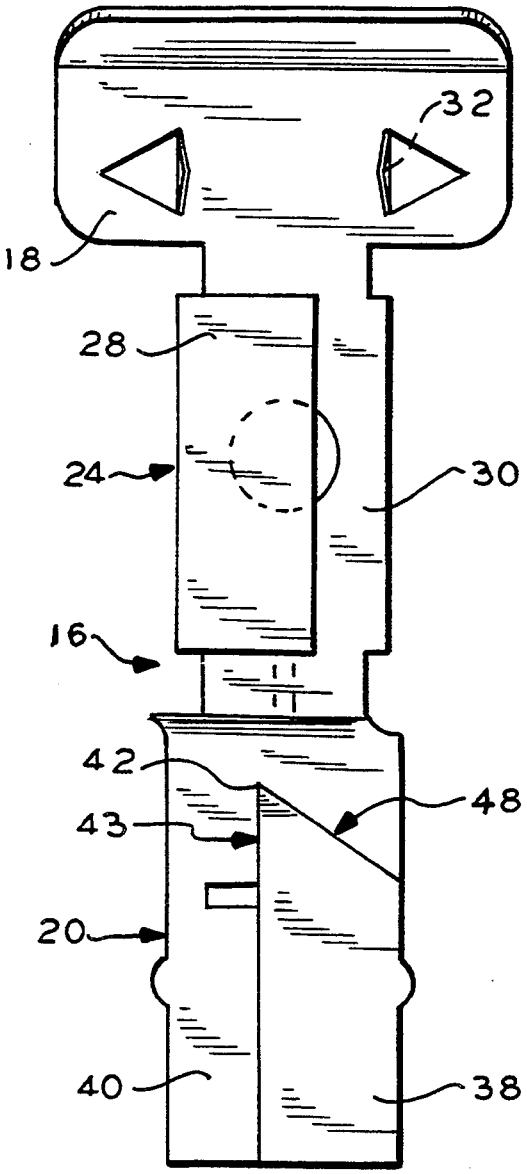
FIG. 2 a top view of a ferrule used in the bag seal of FIG. 1.
Figure 4A:
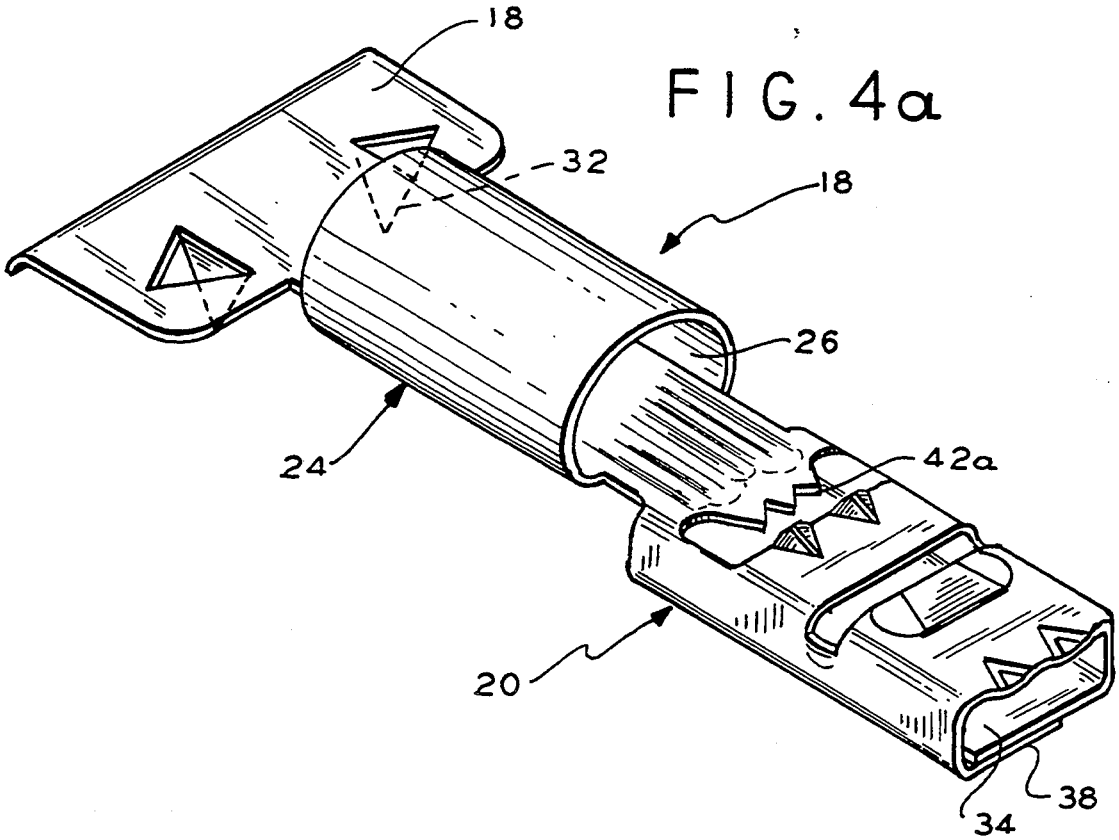
FIG. 4*a* and 4*b* are perspective views of the ferrule shown in FIG. 2.
Figure 4B:
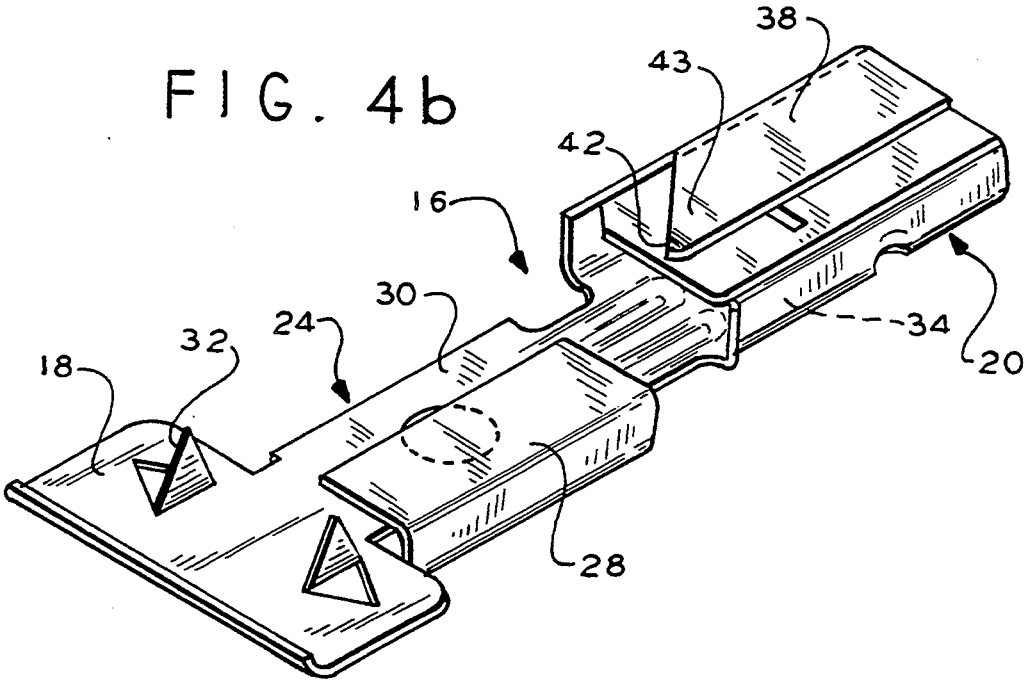

Referring to FIGS. 2, 3, and 4, the ferrule 16 is attached to the first end of the strap 14, by inserting the first end into a chamber 26 defined by the tubular portion 24 and then crimping, clinching or otherwise deforming the tubular portion 24, as shown at 24*x* and 24*y* in FIG. 9*d*. In FIGS. 1 and 8*a*–8*b*, the tubular portion 24 is shown as being sinuously deformed as a result of such crimping or clinching to positively and firmly join the ferrule 16 to the strap 14. As shown in FIGS. 2 and 4*b*, the tubular portion 24 is initially formed by bending wings 28 and 30 of a metal blank so that one wing 28 overlies the other wing 30. Preferably, as shown in FIG. 1, with the seal 10 closing the bag 12, the wings 28, 30 lie against the bag 10 to prevent unfolding thereof or other tampering therewith.

As seen in FIGS. 2, 3 and 4, the flag 18 may include prongs 32 formed therein by appropriate stamping of the blank from which the ferrule 16 is made. When the seal 10 closes the bag 12, the prongs 32 face and dig into the bag 12 to prevent the seal from being slid off the neck of the bag 12, as shown in FIG. 1.

Figure 6:
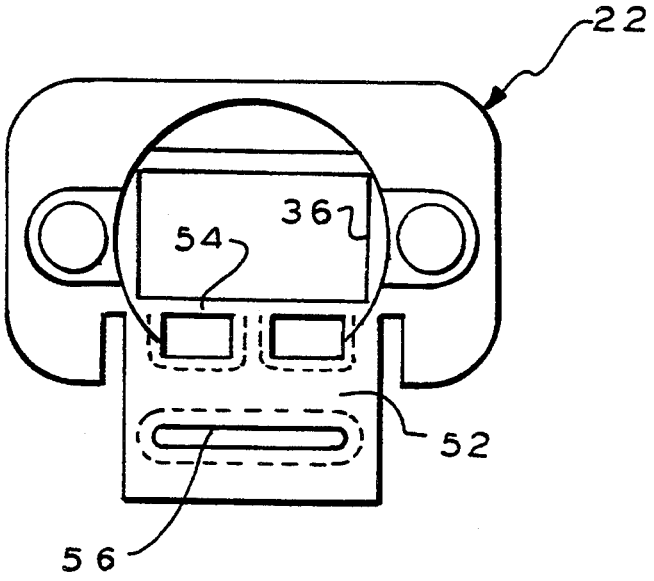
FIG. 6 is an end elevation of the sealing block of FIG. 5.

As seen in FIGS. 2, 3, 4 and 9, the housing 20 includes a passage 34 therethrough. The passage 34 may receive the strap 14 after the second strap end has passed therethrough. The housing 20 is receivable in a bore 36 formed through the sealing block 22, as shown in FIGS. 6, 8 and 9. After the sealing block 22 is placed over the housing 20, with the passage 34 lying within and along the bore 36, the strap 14 is looped around the neck of the bag 12 and its second end is then passed through the passage 34 and out of the bore 36. The strap 14 is then pulled tight (FIGS. 9*a*–9*c*) to firmly close the bag 12 and to embed the prongs 32 into the bag 12 (FIGS. 9*c* and 9*d*), following which the sealing block 22 and the contained housing 20 are clinched, crimped or otherwise deformed (FIG. 9*d*). This clinching appears in FIGS. 1 and 9*d* as a sinuous deformation of the plastic sealing block 22, with the housing 20 (not shown in FIG. 1) being similarly and complementarily deformed.

The deformation of the housing 20 and the sealing block 22 locks the block 22 and housing 20 together, and also locks the strap 14 and the housing 20 together within the passage 34. This closes and seals the bag 12. So far, the structure and function of the seal are as in U.S. Pat. Nos. 3,167,340 and 3,117,812. The tightening of the strap 14 and the deformation of the housing 20 and sealing block 22 may be effected by the tool of U.S. Pat. No. 3,911,970.

If unauthorized entry of the bag 12 is achieved by cutting the strap 14, a visual indication thereof is thereby given. The inaccessibility of the wings 28 and 30 of the deformed tubular portion 24 of the ferrule 16 discourages and/or prevents tampering therewith. If such tampering nonetheless occurs, the inability to accurately reassemble the deformed tubular portion 24 yields a visual indication of tampering. Interlopers will, therefore, usually attack the seal 10 by attempting to remove the housing 20 from the bore 36 of the sealing block 22.

As seen in FIGS. 2 and 4*a*–4*b*, similar to the tubular portion 24, the housing 20 is formed by appropriately folding wings 38 and 40 of the blank from which the ferrule 16 is formed. The sealing block 22 covers these folded wings 38 and 40 to prevent tampering therewith. Attacking the seal 10 by removing the housing 20 from the sealing block 22 carries with the housing 20 the second end of the strap 14. After the strap 14 is unlooped, the bag 12 may be entered. Thereafter, the seal 10 may be reassembled, with no visual indication of unauthorized entry being given, if removal of the housing 20 from the sealing block 22 and its replacement are achieved without cutting, or otherwise visually damaging the sealing block 22. At times, interlopers may be able to defeat the seal 10 in the described manner, if careful use of appropriate tools are employed. The present invention is intended to ensure that removal of the housing 20 from the sealing block 22, though difficult, if achieved, will necessarily result in a visual indication of tampering.

As seen in FIGS. 2, 3, 4 and 9, there is formed on the top wing 38 of the housing 20 a flap 43 having a point or burr 42. The flap 43 has a slight upward curl away from the outer surface of the wing 38. The flap 43 and its point or burr 42 may be formed in any convenient manner which renders it capable of piercing and cutting the sealing block 22. For example, by cutting away a portion of the wing 38 after the housing 20 has been formed by folding the wings 38 and 40.

As seen in FIGS. 3 and 4*a*, on the side of housing 20, opposite to the side having the point or burr 42, there is formed at least one locking point **42*a* projecting away from the outer surface of housing 20. The locking point 42*a* may be formed in any convenient manner which renders it capable of shearing the sealing block 22**.

The housing 20 is inserted into the bore 36 of the sealing block 22 by moving it in the direction of the arrow 44 in FIGS. 1, **5*b*, 7, 8 and 9. During insertion, if the points 42 and 42*a* drag slightly on the wall of the bore 36, neither will penetrate or pierce the sealing block 22. The crimping of the sealing block 22 and the housing 20 (FIG. 9*d*) causes the flap 43 to deform slightly away from the outer surface of the wing 38, thereby causing the tip of points 42 and 42*a* to rest against and partially pierce the wall of the bore 36. Relative movement between the housing 20 and the sealing block 22 incident to an attempt to remove the former from the latter in the direction of the arrow 46, as shown in FIGS. 1, 7, 8 and 9*d*, causes the flap 43 to deform further away from the outer surface of the wing 38 until a critical tensile load is reached, thereby preventing continued deformation of the flap 43. The foregoing causes the tip of point 42 to set in and the tip of locking point 42*a* to penetrate the wail of the bore 36. Continued relative movement in the direction of the arrow 46 thereafter causes the tip of locking point 42*a* to further penetrate the wall of the bore 36 and ultimately to completely penetrate and cut an opening or hole through the sealing block 22**.

An interloper who is familiar with the manner in which the locking point **42*a* shears the sealing block 22, as described in the preceding paragraph, may attempt to flatten the locking point 42*a* before attempting to separate the housing 20 from the sealing block 22. Should this occur, relative movement between the housing 20 and the sealing block 22 incident to an attempt to remove the former from the latter in the direction of the arrow 46, causes the tip of the point 42 to penetrate the wall of the bore 36. Further movement in the direction of the arrow 46 effects further penetration and an increase in the upward curl of the flap 43. The foregoing results in yet further penetration of the point 42 into the sealing block 22 and the cutting of the sealing block 22 by the tip of the point 42 and an angled edge 48 of the flap 43 produced by the formation of the point or burr 42. Ultimately, the point 42 and the edge 48 completely penetrate and cut an opening or hole through the sealing block 22**.

In either case, the opening through the sealing block 22 provides a visual indication of an attempt to separate the housing 20 from the sealing block 22. The force exerted by the locking point **42*a* and/or the point 42 and edge 48 on the wall of the bore 36** as they pierce and cut it render such removal more difficult. Additional points and edges will produce additional visual tamper-indicating openings.

Figure 5A:
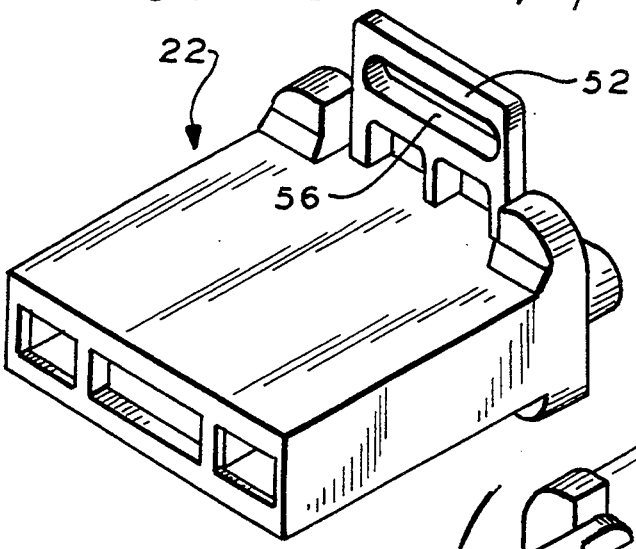
FIGS. 5*a* and 5*b* are perspective views of a sealing block used in the bag seal of FIG. 1.
Figure 5B:
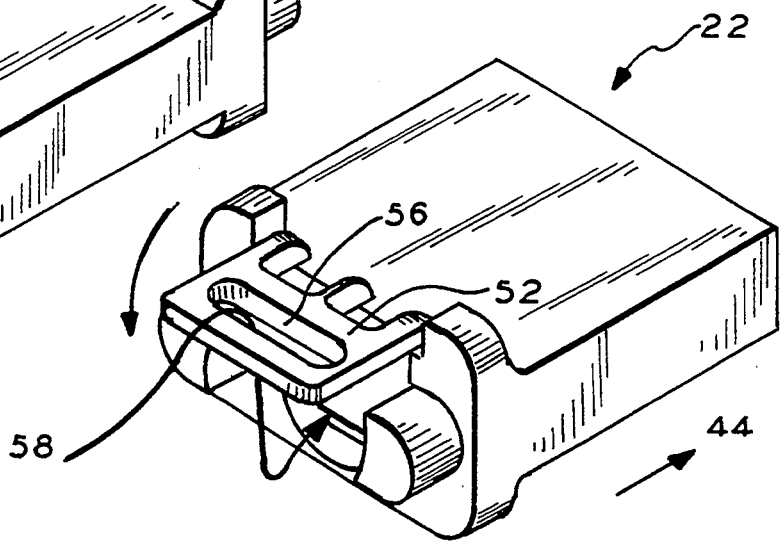
Figure 7:
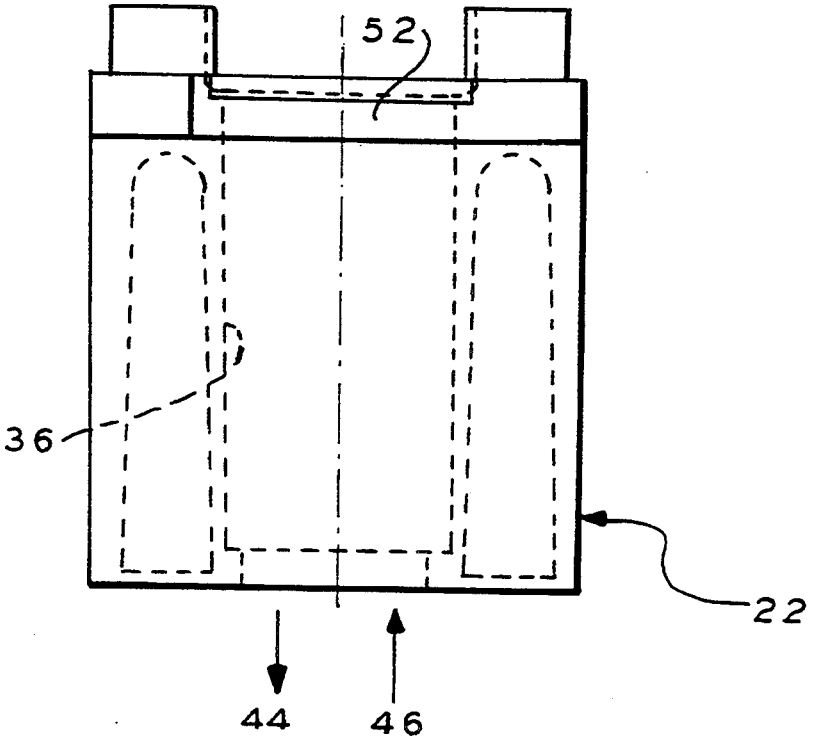
FIG. 7 is a top view of the sealing block of FIG. 5.

As seen in FIGS. 5–7, the sealing block 22 includes a flap 52 rotatably integral therewith via a weakened line of connection 54 (FIG. 6), such as a living hinge. The flap 52 includes a slot 56 through which the strap 14 may pass. As shown by the arrow 58 in FIG. **5*b*, before the second end of the strap 14 is inserted into and through the passage 34 of the housing, it is passed through the slot 56. As the strap 14 is tightened to close the bag 12, the flap 52 rotates from its initial position, shown in FIGS. 5*a* and 9*a*, to the rotated position shown in FIGS. 5*b* and 9*b*, to a further rotated position, shown in FIGS. 9*c*–9*d*. Depending on the degree of tightness of the strap 14, the flap position may lie on the path of removal 46 of the housing 20 from the bore 36 (FIG. 9*d*), in which event successful removal will tear the flap 52 from the sealing block 22 as the housing 20 abuts and moves the flap 52. Whether or not the flap 52 achieves the rotated position shown in FIG. 9*d*, successful and complete removal of the housing 20 from the bore 36 ultimately and necessarily results in the flap being torn from the sealing block 22. The foregoing is due to the fact that, whether removal of the housing 20 is attempted by pulling on the strap 14 or by pushing the housing 20 out of the bore 36, either the housing 20 will abut the flap 52 or the tight strap 14 will exert tearing force on the slot 56. In any event, the tearing, partial or complete, of the flap 52 from the sealing block 22 provides a visual indication of tampering with the seal 10**.

An interloper who is familiar with the manner in which the present invention provides a visual indication of tampering may attempt to disassemble the seal 10 and replace the strap 14 and the sealing block 22 with a new strap and/or sealing block to eliminate the visual evidence of tampering. If such reassembly with new parts is permitted, an interloper is free to disassemble the seal, enter the bag in an authorized fashion and thereafter reassemble the seal with new parts without any visual indication of unauthorized tampering being given.

Accordingly, the present invention contemplates the use of identifying indicia 60, 62 on the strap 14 and the sealing block 22 respectively, as is shown in FIGS. 1 and **8*a*. Identifying indicia 60, 62 permit the end user to identify specifically which strap 14 and which sealing block 22 are being utilized to seal a specific bag. An interloper, therefore, will not be able to disassemble the seal 10 and thereafter reassemble the seal 10 with a new strap 10 or a new sealing block 22 without a field capacity to provide identifying indicia on otherwise blank straps and sealing blocks. The use of a counterfeit strap 10 and/or sealing block 22 will be readily identifiable due to the lack of identifying indicia 60, 62 or difference between identifying indicia 60, 62** and the counterfeit indicia, it being highly unlikely that acceptable counterfeiting of indicia can be achieved in the field.

The flap-locking point configuration 43–42*a*, the flap-point-edge configuration 43–42–48, the flap 52, and the identifying indicia 60–62 may be used separately or together to provide a visual indication of tampering with the seal 10. Joint use produces back-up or redundant tampering indications.

We claim:

1. An improved bag seal including a flexible strap for encircling and closing the neck of a bag, a plastic body with a bore therethrough, and a non-resilient ferrule attachable to a first end of the strap; the ferrule including an integral housing having therethrough a passage which is capable of receiving the strap after its second end passes therethrough; the housing being insertable into the bore; the plastic body and the housing being jointly crimped after the housing is received in the bore and the strap has been passed through the passage and tightened to encircle and close the neck of the bag to deform the plastic body and the housing, thereby locking the housing to the plastic body and the strap to the housing, wherein the improvement comprises:

cutting means formed on the housing for permitting reception of the housing in the bore without adversely affecting the plastic body and for cutting and piercing through the plastic body in response to relative movement between the ferrule and the plastic body incident to removal or attempted removal of the housing from the bore, the pierced and cut plastic body providing a visual indication of such removal or attempted removal.

2. A bag seal as in claim 1, wherein:

the cutting means includes a point on the exterior of the housing.

3. A bag seal as in claim 2, wherein:

the cutting means includes a cutting edge terminating in the point.

4. A bag seal as in claim 3, wherein:

the housing comprises a pair of wings, one folded over the other, and the point and the cutting edge result from removal of a portion of the overlying wing.

5. A bag seal as in claim 3, wherein:

the point and the cutting edge are integral with a member which is in turn integral with the housing, the member being slightly deformed to raise the point away from the housing so that the point rests against a wall of the bore as and after the housing is inserted into the bore and so that the point penetrates and the edge cuts the bore wall as the housing is withdrawn from the bore.

6. A bag seal as in claim 2, wherein:

the housing having a plurality of sides, a member integral to and extending outwardly from a first side of the housing and the point extending outwardly from a second side of the housing opposite the first side, the member being slightly deformed upon the insertion of the housing into the bore so that the point is caused to rest against the wall of the bore and as the housing is withdrawn from the bore, the member being further deformed to cause the point to penetrate and shear the bore wall.

7. An improved bag seal including a flexible strap for encircling and closing the neck of a bag, a plastic body with a bore therethrough, and a non-resilient ferrule attachable to a first end of the strap; the ferrule including an intregal housing having therethrough a passage which is capable of receiving the strap after its second end passes therethrough; the housing being insertable into the bore; the plastic body and the housing being crimped after the housing is received in the bore and the strap has been passed through the passage and tightened to encircle and close the neck of the bag to deform the plastic body of the housing, thereby locking the housing to the plastic body and the strap to the housing, wherein the improvement comprises:

a flap rotatably attached to the plastic body near an end of the bore, the flap having a slot through which the strap and its second end pass before they pass through the passage, the presence of the strap through the slot and the passage with the strap tightened to encircle the bag neck rotating the flap so that removal or attempted removal of the housing from the bore partially or completely tears the flap from the body to provide a visual indication of such removal or attempted removal.

8. A bag seal as in claim 7, wherein:

the flap is rotated so as to be in the path of removal of the housing from the bore, abutment of the housing against the flap during such removal tearing the flap from the plastic body.

9. A bag seal as in claim 7, wherein:

the flap is rotated so that removal of the housing from the bore causes the tightened strap to pull against the slot and to tear the flap from the plastic body.

10. An improved bag seal including a flexible strap for encircling and closing the neck of a bag, a plastic body with a bore therethrough, and a non-resilient ferrule attachable to a first end of the strap; the ferrule including an integral housing having therethrough a passage which is capable of receiving the strap after its second end passes therethrough; the housing being insertable into the bore; the plastic body and the housing being jointly crimped after the housing is received in the bore and the strap has been passed through the passage and tightened to encircle and close the neck of the bag to deform the plastic body and the housing, thereby locking the housing to the plastic body and the strap to the housing, wherein the improvement comprises:

identifying indicia affixed to the seal for providing a visual indication of the specific seal components utilized to encircle and close the bag; and cutting means formed on the housing for permitting reception of the housing in the bore without adversely affecting the plastic body and for cutting and piercing through the plastic body in response to relative movement between the ferrule and the plastic body incident to removal or attempted removal of the housing from the bore, the pierced and cut housing providing a visual indication of such removal or attempted removal.

11. A bag seal as in claim 10, wherein:

the identifying indicia is affixed to the strap so as to provide a visual indication of the specific strap utilized to seal the bag.

12. A bag seal as in claim 10, wherein:

the identifying indicia is affixed to the plastic body so as to provide a visual indication of the specific plastic body utilized to seal the bag.

13. A bag seal as in claim 10, wherein:

a first identifying indicia is affixed to the strap, and a second identifying indicia is affixed to the plastic body, so as to provide a visual indication of the specific strap and plastic body utilized to seal the bag.

14. A bag seal of claim 10, wherein the improvement further comprises:

a flap rotatably attached to the plastic body near an end of the bore, the flap having a slot through which the strap and its second end pass before they pass through the passage, the presence of the strap through the slot and the passage with the strap tightened to encircle the bag neck rotating the flap so that removal or attempted removal of the housing from the bore partially or completely tears the flap from the body to provide a visual indication of such removal or attempted removal.

15. An improved bag seal including a flexible strap for encircling and closing the neck of a bag, a plastic body with a bore therethrough, and a non-resilient ferrule attachable to a first end of the strap; the ferrule including an integral housing having therethrough a passage which is capable of receiving the strap after its second end passes therethrough; the housing being insertable into the bore; the plastic body and the housing being jointly crimped after the housing is received in the bore and the strap has been passed through the passage and tightened to encircle and close the neck of the bag to deform the plastic body and the housing, thereby locking the housing to the plastic body and the strap to the housing, wherein the improvement comprises:

cutting means formed on the housing for permitting reception of the housing in the bore without adversely affecting the plastic body and for cutting and piercing the plastic body in response to relative movement between the ferrule and the plastic body incident to removal or attempted removal of the housing from the bore, the pierced and cut housing providing a visual indication of such removal or attempted removal; and a flap rotatably attached to the plastic body near an end of the bore, the flap having a slot through which the strap and its second end pass before they pass through the passage, the presence of the strap through the slot and the passage with the strap tightened to encircle the bag neck rotating the flap so that removal or attempted removal of the housing from the bore partially or completely tears the flap from the body to provide a visual indication of such removal or attempted removal.

16. A bag seal as in claim 15, wherein the invention further comprises:

identifying indicia affixed to the seal for providing a visual indication of the specific seal utilized to encircle and close the bag.

* * * * *